US007347337B2

(12) United States Patent
Schultheis et al.

(10) Patent No.: US 7,347,337 B2
(45) Date of Patent: Mar. 25, 2008

(54) FEEDING BOTTLE

(75) Inventors: Joseph E. Schultheis, Evansville, IN (US); Thomas C. Horton, Newburgh, IN (US)

(73) Assignee: Bristol-Myers Squibb Company - Mead Johnson & Company, Evansville, IN (US)

( * ) Notice: Subject to any disclaimer, the term of this patent is extended or adjusted under 35 U.S.C. 154(b) by 198 days.

(21) Appl. No.: 11/272,622

(22) Filed: Nov. 14, 2005

(65) Prior Publication Data

US 2007/0108151 A1 May 17, 2007

(51) Int. Cl.
*A61J 9/00* (2006.01)
*A61J 11/00* (2006.01)
*B65D 23/10* (2006.01)

(52) U.S. Cl. ..... 215/11.1; 215/384; 215/398; 426/117

(58) Field of Classification Search ..... 215/11.1, 215/398, 384; D24/197; 426/117
See application file for complete search history.

(56) References Cited

U.S. PATENT DOCUMENTS

| | | | | |
|---|---|---|---|---|
| 1,610,136 | A | 12/1926 | Kelty | 215/11.1 |
| 1,947,753 | A | 2/1934 | Block | 215/11.1 |
| D99,270 | S | 4/1936 | Dache-Despres | |
| D105,669 | S | 8/1937 | Mills | |
| D189,373 | S | 11/1960 | Lerner | D58/8 |
| D198,870 | S | 8/1964 | Hedgecock | D58/8 |
| 3,145,867 | A | 8/1964 | Roberts et al. | 215/11.1 |
| 3,162,318 | A | 12/1964 | Woodbury, Jr. | 215/11 |
| D202,003 | S | 8/1965 | Douglas | D58/17 |
| 3,243,069 | A | 3/1966 | Duerme | 215/11 |
| D209,715 | S | 12/1967 | Ninesling et al. | D58/8 |
| D218,148 | S | 7/1970 | Noyes et al. | D9/118 |
| 3,645,262 | A | 2/1972 | Harrigan | 604/77 |
| D223,438 | S | 4/1972 | Lluch | D9/169 |
| D225,212 | S | 11/1972 | Mandiargues | D9/169 |
| 3,746,198 | A | 7/1973 | Howland | 215/11.1 |
| D230,256 | S | 2/1974 | Ckola | D9/102 |
| 3,804,952 | A * | 4/1974 | MacDonald | 426/117 |
| 3,838,784 | A | 10/1974 | Barton et al. | 215/11.1 |
| 4,676,387 | A | 6/1987 | Stephenson et al. | 215/11 R |
| 4,703,863 | A | 11/1987 | Kohus | 215/11.1 |
| D335,450 | S | 5/1993 | Pezzoli et al. | D9/500 |
| D337,271 | S | 7/1993 | Pezzoli et al. | D9/503 |
| 5,263,599 | A | 11/1993 | Sklar | 215/11.1 |
| D347,066 | S * | 5/1994 | Malcolm et al. | D24/197 |
| 5,316,160 | A | 5/1994 | Cautereels | 215/11.1 |
| D356,160 | S | 3/1995 | Cautereels | D24/197 |
| 5,531,338 | A | 7/1996 | Sklar | 215/11.1 |
| 5,807,156 | A | 9/1998 | Owen | 446/77 |

(Continued)

FOREIGN PATENT DOCUMENTS

| | | | |
|---|---|---|---|
| FR | 2576686 | 8/1986 | 215/11.1 |

(Continued)

*Primary Examiner*—Sue A. Weaver
(74) *Attorney, Agent, or Firm*—Richard D. Schmidt

(57) ABSTRACT

A feeding bottle including an upper and lower circular-shaped cylindrical body portion having a first radius, a generally triangular-shaped cylindrical body portion intermediate the cylindrical upper and lower body portions, wherein said generally triangular body portion includes a first and a second planar wall and an arched third wall defined by a third radius perpendicular to said central longitudinal axis to provide a "V-shaped" section.

20 Claims, 4 Drawing Sheets

U.S. PATENT DOCUMENTS

| | | | | |
|---|---|---|---|---|
| D420,448 | S | 2/2000 | Brown et al. | D24/197 |
| D423,107 | S | 4/2000 | Brown et al. | D24/197 |
| D453,113 | S * | 1/2002 | Feen et al. | D9/561 |
| 6,786,344 | B2 | 9/2004 | Kipperman et al. | 215/11.1 |
| D511,836 | S * | 11/2005 | Morano et al. | D24/197 |
| 2005/0056614 | A1 * | 3/2005 | Morano et al. | 215/396 |

FOREIGN PATENT DOCUMENTS

| | | |
|---|---|---|
| WO | WO 88/04261 | 6/1888 |

* cited by examiner

FEEDING BOTTLE

FIELD OF THE INVENTION

The present invention relates to the field of feeding bottle constructions in general and, more particularly, to an ergonomically designed feeding bottle.

BACKGROUND OF THE INVENTION

The prior art is replete with varying feeding bottle sizes and constructions. Some of these are configured to facilitate washing, with little or no consideration given to the need for the caregiver to hold the bottle. Still others appear to be configured to facilitate holding of the bottle by an infant. Most, if not all, bottles neglect the special needs that arise when feeding premature infants.

While the prior art constructions may be adequate for the basic purpose and function for which they have been specifically designed, they are uniformly deficient with respect to their failure to provide a simple, efficient, and practical infant feeding bottle. Moreover, given the recent increase in multiple birth events attributable to both fertility drugs and in vitro techniques, a problem has arisen for those parents who are faced with feeding multiple newborns at regular intervals. As a consequence of the foregoing situation, a need has arisen for a new and improved ergonomically designed feeding bottle construction that will simplify the feeding process and substantially reduce wrist fatigue experienced by parents and caregivers who spend countless hours each day coping with multiple infant feedings or the feeding of premature infants.

SUMMARY OF THE INVENTION

The present invention recognizes and addresses disadvantages of prior art constructions and methods, and it is an object of the present invention to provide an improved feeding bottle, such as a baby bottle. This and other objects may be achieved by a feeding bottle comprising a circular-shaped cylindrical upper body portion having a first radius perpendicular to a central longitudinal axis; a circular-shaped cylindrical lower body portion having a second radius perpendicular to the central longitudinal axis; an open top; a circular base; and a generally triangular-shaped cylindrical body portion intermediate the circular-shaped cylindrical upper and lower body portions having a first and a second generally planar wall and an arched third wall that is defined by a third radius perpendicular to the central longitudinal axis. The third radius is substantially equal to the first and the second radii, and a cross-sectional area of the generally triangular-shaped cylindrical body portion is smaller than a cross-sectional area of each of the circular-shaped cylindrical upper and lower body portions where each cross-section is taken perpendicular to the central longitudinal axis.

The bottle also has a cylindrical top portion proximate the upper body portion that defines a helical thread on an outer circumference thereon. A flange is formed between the helical thread and the upper body portion. The threaded cylindrical top portion is adapted to removably receive a closure.

The closure may include an annular cap and an annular end wall defining an aperture therein. A nipple having a radially extending annular flange with a maximum outer radius substantially equal to the inner radius of the annular cap is press fit into the under side of the annular cap. A helical thread formed on the inner circumference of the annular cap receives the helical thread on the cylindrical top portion for removably securing the annular cap to the cylindrical top portion. Compressing the outer edge portion of the nipple flange between the bottom surface of the annular end wall and the top rim portion forms a liquid-tight seal as the closure is screwed onto the cylindrical top portion of the bottle.

BRIEF DESCRIPTION OF THE DRAWINGS

A full and enabling disclosure of the present invention, including the best mode thereof directed to one of ordinary skill in the art, is set forth in the specification, which refers to the appended Figures, in which.

DETAILED DESCRIPTION OF THE INVENTION

Figure 1:
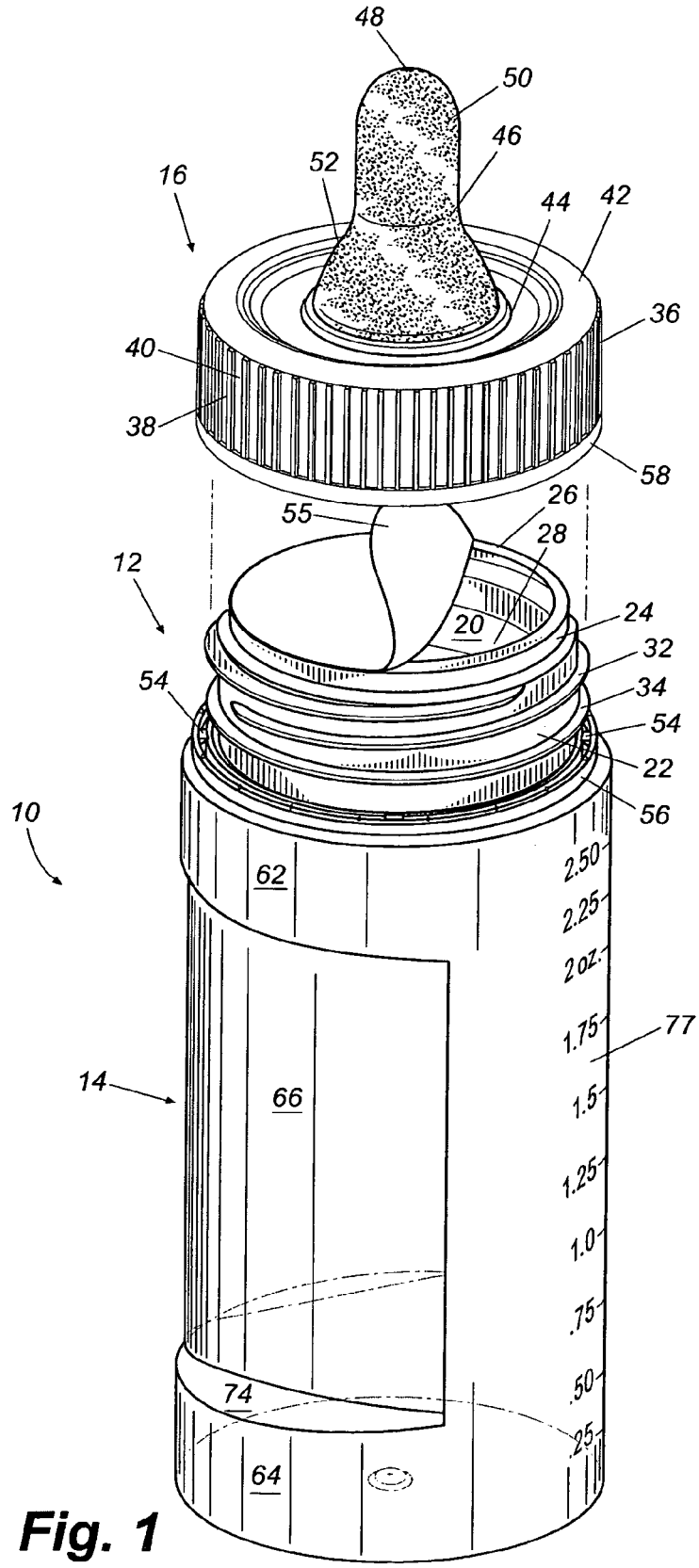
FIG. 1 is a perspective view of a feeding bottle embodying the design of the present invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

A repeat use of reference characters in the present specification and drawings represents the same or analogous features or elements of the invention.

With reference now to the drawings, and in particular to FIG. 1, an embodiment of the new and improved infant feeding bottle generally designated by the reference numeral 10 will be described. Bottle 10 includes a cylindrical top portion designated generally by the numeral 12, a body portion designated generally by the numeral 14, and a closure designated generally by the numeral 16. Cylindrical top portion 12 and body 14 may be integrally molded of a suitable polymer material, which may be blow molded, by extrusion or injection, so that it is a unitary member of uniform wall thickness. Suitable transparent polymers for forming the bottle include, but are not limited to, polystyrene, polystyrene-acrylonitile, acrylonitile-butadiene-styrene, styrene-maleicanhydride, polycarbonate, polyethylene terephthalate, polyvinylcyclohexane, and blends thereof.

Figure 2:
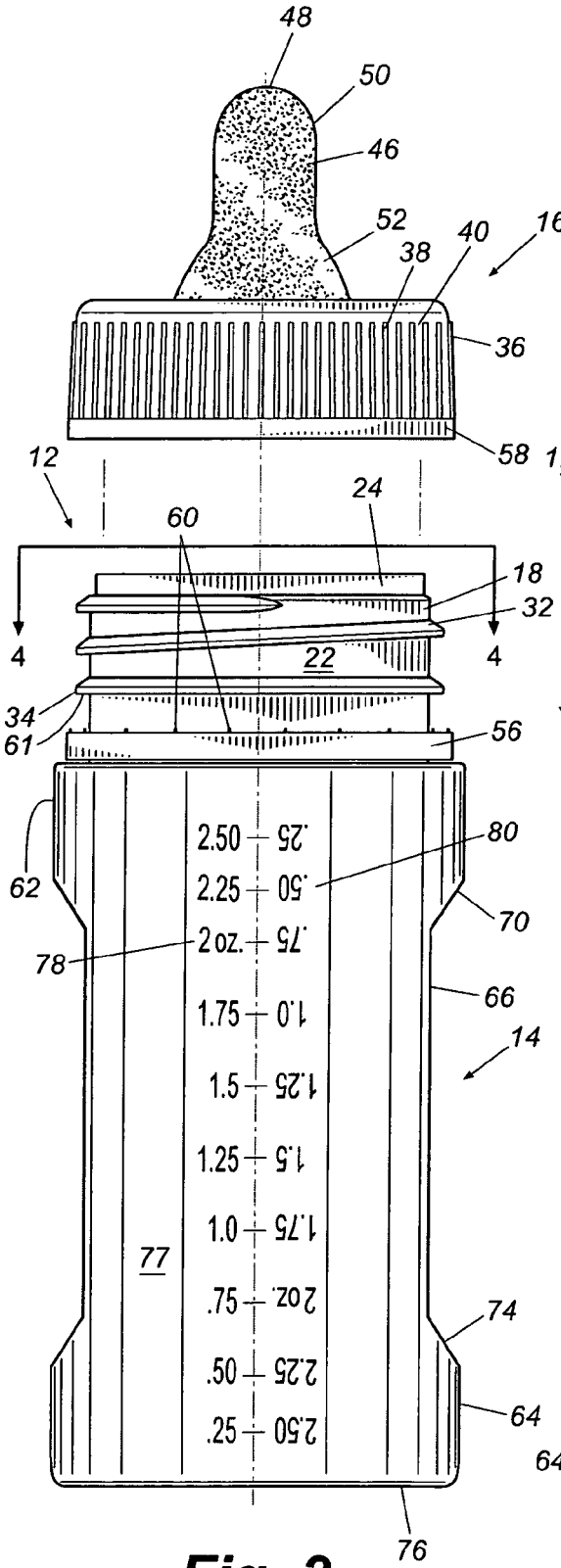
FIG. 2 is a front elevational view of the feeding bottle illustrated in FIG. 1.

Referring to FIG. 2, threaded cylindrical top portion 12 includes a cylindrical portion 18 having an outer circumference 22. A radius R1 (FIGS. 4 and 5) defines an inner circumference 20 of cylindrical portion 18. A mouth 24 and a rim 26 are integrally formed on cylindrical portion 18. Mouth 24 defines an aperture 28 in fluid communication with an inner chamber 30 (FIGS. 4 and 5) of body 14. The mouth end is adapted for the removable receipt of closure 16. A helical thread 32 is integrally formed on outer circumference 22 of cylindrical portion 18 for removably securing closure 16 to cylindrical top portion 12. Helical thread 32 begins at a point where mouth 24 connects to cylindrical portion 18 and terminates proximate a flange 34.

Referring to FIG. 1, closure 16 includes an annular cap 36 having a helical thread (not shown) on its inner circumference for removably securing cap 36 to the externally threaded cylindrical top portion 12. Outer circumference 40 of annular cap 36 may contain ribs or knurling 38. Ribs 38 allow the caregiver to more easily grip closure 16 to remove it from or fit it on top portion 12. In addition to its internally threaded cylindrical wall, cap 36 includes an annular end wall 42 having an interior peripheral rim 44 dimensioned to fit into a groove (not shown) in a nipple 46. Nipple 46 and annular cap 36 can thus be press fit together to form closure 16.

Figure 6:
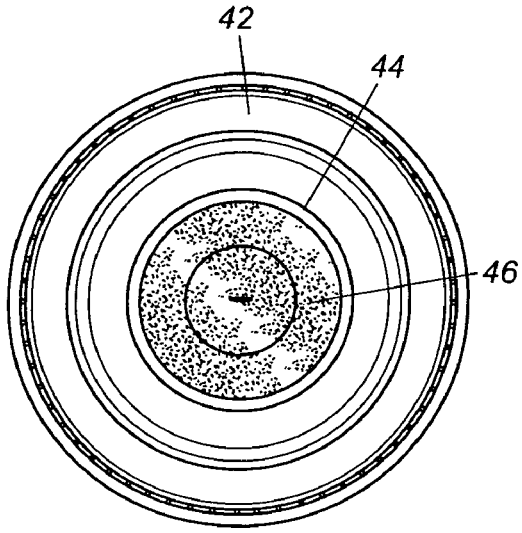
FIG. 6 is a top view of the feeding bottle illustrated in FIG. 1.

With reference to FIGS. 1 and 6, nipple 46 has a nearly flat or very shallowly curved surface 48 at the end of a mouthpiece 50. Nipple 46 widens out to a frustoconical section 52 located intermediate an annular flange (not shown) and mouthpiece 50. The annular flange is dimensioned to seat on rim 26 of mouth 24, and it defines a central aperture (not shown), which is in fluid communication with aperture 28 and chamber 30. The aperture defined by the annular flange allows fluid to flow from body 14 into and through nipple 46. A soft, pliable material such as conventional or silicone rubber may be used to form nipple 46. However, it should be understood that other suitable polymers may be used.

Nipple 46 is press fit into annular cap 36 so that peripheral rim 44 engages the external annular groove (not shown) in nipple 46. Thus, mouthpiece 50 and frustoconical portion 52 extend upward through annular cap 36 so that the annular flange (not shown) engages a rearward surface of annular end wall 42. In this configuration, an outer most edge portion of the annular flange is in abutting contact with the inner circumference of annular cap 36. Thus, threadably securing closure 16 onto threaded cylindrical portion 12 causes the rearward surface of annular end wall 42 to compress the annular flange against rim 26 to form a liquid-tight seal.

Still referring to FIG. 1, an optional releasable seal 55 attached to rim 26 over mouth 24 allows for vacuum packaging of the infant formula in bottle 10. One skilled in the art of baby formula or food packaging should be familiar with such releasably attached seals for vacuum packaging. Specifically, adhesive or heat attaches a seal formed of polyvinyl chloride, polystyrene, or other suitable material to mouth 24 to form an airtight seal. Therefore, removal of closure 16 will not disturb the vacuum seal unless the seal is cut or removed.

Formula may be prepackaged in bottle 10 as liquid or powdered infant formula, in particular, formula for premature babies. The packaged infant formula would typically be pre-measured and vacuum sealed to prevent spoilage. If bottle 10 is packaged with powdered formula, the user would add the specified amount of water as a diluent. Bottle 10 may also contain infant or toddler formula, depending on the intended target market, and it may be sold individually or in a multiple bottle pack.

Figure 3:
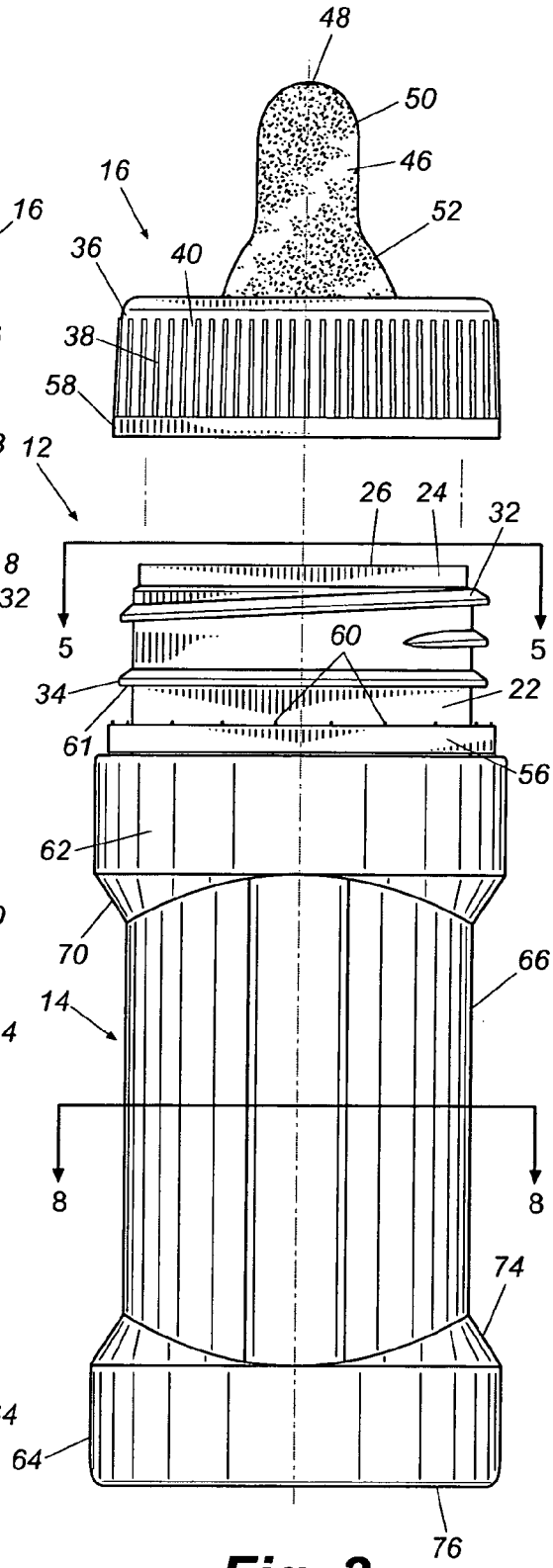
FIG. 3 is a back elevational view of the feeding bottle illustrated in FIG. 1.
Figure 4:
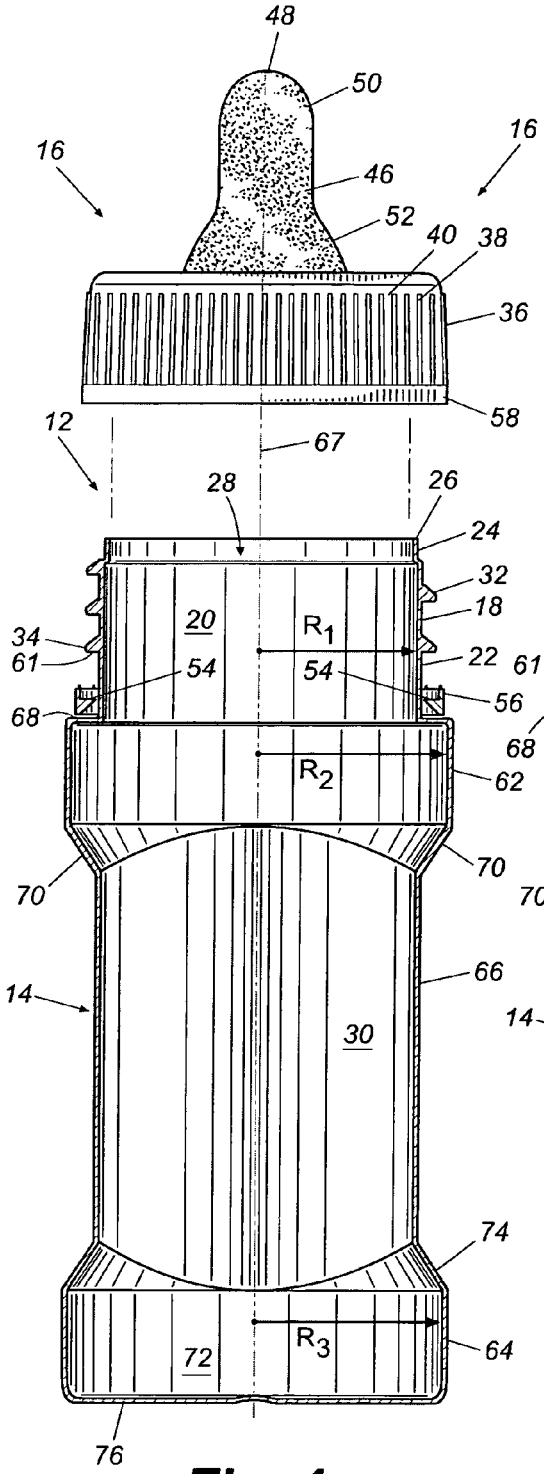
FIG. 4 is a cross-sectional view along line 4-4 of the feeding bottle shown in FIG. 2.
Figure 5:
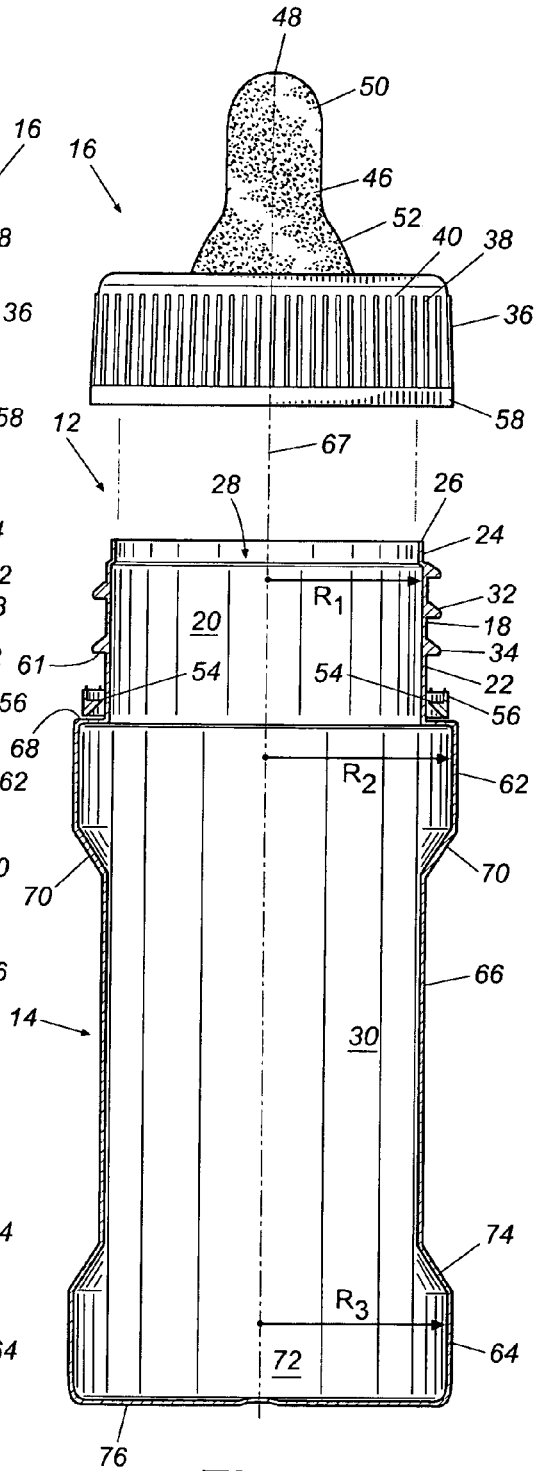
FIG. 5 is a cross-sectional view along line 5-5 of the feeding bottle shown in FIG. 3.
Figure 8:
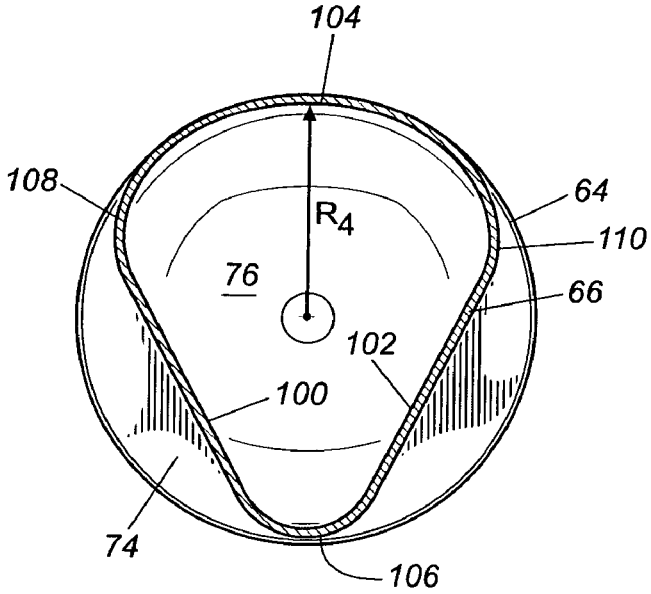
FIG. 8 is a cross-sectional view of the bottle in FIG. 3 along line 8-8 looking down the central body portion.

Referring again to FIGS. 2 and 3, in addition to releasably attached seal 55, bottle 10 and enclosure 16 may also include an anti-tamper ring 56. Anti-tamper ring 56 connects to a lower edge 58 of annular cap 36 by a plurality of relatively thin and frangible breakaway tongues or webs 60. Internally, radially inwardly projecting and angularly extending ridges 54 (FIGS. 4 and 5) are formed on an inner circumference of ring 56 which engage an under surface 61 (FIGS. 4 and 5) of radially outwardly projecting flange 34. Thus, tensile forces rotationally fix anti-tamper ring 56 to flange 34 as annular cap 38 is unthreaded off bottle 10. As annular cap 38 is rotationally removed, both tensile and torsional forces acting on webs 60 cause the webs to sever allowing annular cap 38 to be completely removed Referring generally to FIG. 1, body 14 comprises a generally cylindrical upper portion 62, a generally cylindrical lower portion 64, and a tubular body midsection 66 having a generally triangular cross-section (FIG. 8). As illustrated in FIGS. 4 and 5, the body is a tubular member that defines chamber 30 and has a central longitudinal axis 67.

Still referring to FIGS. 4 and 5, upper body portion 62 is located intermediate threaded cylindrical top portion 12 and body midsection 66, and it is in fluid communication with aperture 28 and chamber 30. Upper body portion 62 is tubular in shape and connects to top portion 12 by an inwardly extending shoulder 68 and to central portion 66 by an outwardly sloping shoulder 70. A length of, for example, approximately ¼ inch and a radius R2 define cylindrical upper portion 62. Radius R2 is larger than radius R1 and may vary depending on the application of the bottle. The length of upper portion 62 may be larger or smaller depending on the volume of liquid held by bottle 10. While a 3-oz bottle 10 is shown in the figures, the bottle 10 can have various volumes, depending on the particular application.

Figure 7:
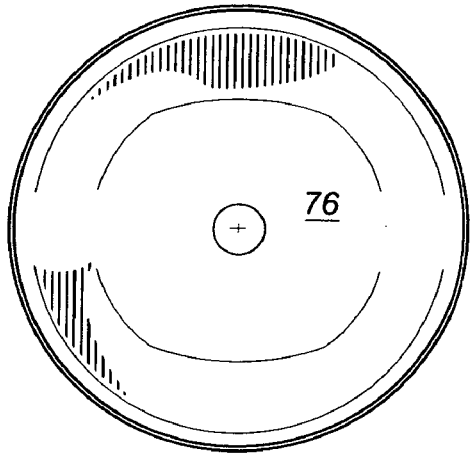
FIG. 7 is a bottom view of the feeding bottle illustrated in FIG. 1.

Lower body portion 64 connects to body midsection 66 and defines a chamber 72, which is in fluid communication with chamber 30. Lower portion 64 has an axial length of, for example, approximately ¼ inch and a radius R3. As shown in FIG. 7, lower body portion 64 terminates in a circular base 76. Circular base 76 may be flat, or it may have a concave center portion allowing bottle 10 to stand upright. Lower portion 64 connects to body midsection 66 by an inwardly sloping shoulder 74. The length of lower portion 64 may be larger or smaller, but radius R3 is substantially equal to upper body portion radius R2. As will be appreciated by those skilled in the art, the fact that upper 62 and lower 64 portion each include a circular sidewall of substantially the same radius and centered about central longitudinal axis 67 enables bottle 10 to be readily molded and removed from the molding machine.

As illustrated in FIG. 8, midsection 66 is constructed and sized to be held within the crook between fingers, such as the index and middle finger, of a person holding bottle 10 when feeding an infant. To that end, body midsection 66 is generally triangular in shape with a first wall 100, a second wall 102 and an arched third wall 104. First and second walls 100 and 102 are generally planar and arched third wall 104 is defined by a radius R4 that is substantially equal to radii R2 and R3. First and second walls 100 and 102 are connected by a curved corner 106, and arched third wall 104 connects to first and second walls 100 and 102 by respective curved corners 108 and 110. The axial length of midsection 66 is approximately 2¼ inches and may vary depending on the volume of liquid to be carried in bottle 10. Radius R4 may be substantially equal to upper and lower body portion radii R2 and R3, and slightly larger than threaded top portion radius R1. This configuration forms a generally triangular- or "V-shaped" midsection.

A generally triangular-shaped midsection is advantageous over a circular-shaped midsection for several reasons. First, it ensures that midsection 66 has a sufficiently narrow portion that enables a caregiver to comfortably hold bottle 10. Furthermore, a generally triangular cylindrical midsection holds a larger quantity of formula than a bottle having a circular cylindrical midsection having a diameter substantially equal to the smallest width between side walls 100 and 102. That is, in order for a circular cylindrical midsection to be held comfortably between two figures, its diameter must be substantially equal to the smallest width of triangular midsection 66. In addition, a generally triangular-shaped midsection having a wall defined by radius R4 that is substantially equal to radii R2 and R3 provides a larger area for labeling the bottle.

Turning once again to FIG. 2, it can be seen that front surface 77 of body midsection 66 may be provided with indicia 78, wherein indicia 78 register the fluid content of bottle 10 in an upright position. A second set of indicia 80 may be included on the front surface of body midsection 66. Indicia 80 register the remaining fluid content in the inverted feeding position so that these visual indicia will be readily available to the caregiver during feedings. One of ordinary skill in the art should understand that the range of measurements differ between the upright and inverted positions due to the volume of liquid held in threaded cylindrical top portion 12. Indicia 78 and 80 may be formed during the molding of the bottle 10, for example, through injection molding, or may be provided on a label.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What is claimed is:

1. A feeding bottle comprising:

a. a circular-shaped cylindrical upper body portion having a first radius perpendicular to a central longitudinal axis;

b. a circular-shaped cylindrical lower body portion having a second radius perpendicular to said central longitudinal axis, an open top, and a circular base; and c. a generally triangular-shaped cylindrical body portion intermediate said circular-shaped cylindrical upper and lower body portions, said generally triangular-shaped body portion including a first and a second generally planar wall and an arched third wall defined by a third radius perpendicular to said central longitudinal axis, wherein said third radius is substantially equal to said first and said second radii, and wherein a cross-sectional area of said generally triangular-shaped cylindrical body portion is smaller than a cross-sectional area of each of said circular-shaped cylindrical upper and lower body portions each cross-section taken perpendicular to said central longitudinal axis.

2. The feeding bottle in claim 1, said bottle further comprising a cylindrical top portion adapted to removably receive a closure.

3. The feeding bottle in claim 2, said bottle further comprising a closure.

4. The feeding bottle in claim 3, said cylindrical top portion further comprising:

a. a first helical thread formed on an outer circumference of said cylindrical top portion;

b. a top rim portion; and c. an annular flange formed on said outer circumference of said cylindrical top portion and located axially below said first helical thread.

5. The feeding bottle in claim 4, said bottle further comprising an anti-tamper ring, said ring being removably attached by a plurality of frangible breakaway tongues to a bottom rim of said closure.

6. The feeding bottle in claim 5, said ring further comprising radially inwardly extending ridges for engaging a bottom surface of said annular flange, wherein said ring removably secures said closure to said cylindrical top portion.

7. The feeding bottle in claim 4, said closure further comprising:

a. an annular cap, said cap comprising, an annular end wall defining an aperture therein, and a second helical thread formed on an inner circumference of said annular cap, and b. a nipple that is press-fitable to a bottom surface of said annular end wall and extending through said aperture, wherein said second thread is adapted to receive said first thread for removably receiving said annular cap onto said cylindrical top portion.

8. The feeding bottle in claim 7, said nipple further comprising a radially extending annular flange having an outer radius substantially equal to the inner radius of said annular cap, wherein said radially extending annular flange is compressible between the bottom surface of said annular end wall and said cylindrical top portion rim as said annular cap is threadably received by said cylindrical top portion to form a liquid-tight seal.

9. A feeding bottle comprising:

a. a cylindrical top portion adapted to removably receive a closure, said top portion having a circular upper rim portion defining a mouth;

b. a circular-shaped cylindrical upper body portion having a first radius, said circular-shaped cylindrical upper body portion integrally formed with said cylindrical threaded top portion;

c. a circular-shaped cylindrical lower body portion having a second radius;

d. a generally triangularly-shaped cylindrical body portion intermediate said circular-shaped cylindrical upper and lower body portions and in fluid communication with said mouth, said generally triangular-shaped body portion including a first and a second generally planar wall and an arched third wall defined by a third radius perpendicular to said central longitudinal axis, wherein said third radius is substantially equal to said first and said second radii and wherein a cross-sectional area of said generally triangular-shaped cylindrical body portion is smaller than a cross-sectional area of each of said circular-shaped cylindrical upper and lower body portions each cross-section taken perpendicular to said central longitudinal axis; and e. a closure.

10. The feeding bottle in claim 9, said bottle further comprising a removably attached safety seal over said mouth and to said circular upper rim portion.

11. The feeding bottle in claim 9 said cylindrical top portion further comprising:

a. a first helical thread formed on an outer circumference of said cylindrical top portion; and b. an annular flange formed on said outer circumference of said cylindrical top portion and located axially below said first helical thread.

12. The feeding bottle in claim 11, said closure comprising an annular cap, said cap comprising, an annular end wall defining an aperture therein, and a second helical thread formed on an inner circumference of said annular cap.

13. The feeding bottle in claim 12, said bottle further comprising a nipple having a radially extending annular flange with an outer radius substantially equal to an inner radius of said annular cap, wherein said nipple is press fitable into said annular cap, whereby said annular flange is compressible between a bottom surface of said annular end wall and said upper rim portion as said annular cap is threadably received by said cylindrical top portion to form a liquid-tight seal.

14. A feeding bottle comprising:

a. a cylindrical top portion adapted to receive a closure and comprising:

a first helical thread formed on an outer circumference;

an annular flange located proximate said threads; and a circular upper rim defining a mouth, b. a circular-shaped cylindrical upper body portion having a first radius;

c. a circular-shaped cylindrical lower body portion having a second radius;

d. a generally triangularly-shaped cylindrical body portion intermediate said circular-shaped cylindrical upper and lowerbody portions and in fluid communication with said mouth, said generally triangular-shaped body portion including a first and a second generally planar wall and an arched third wall defined by a third radius perpendicular to said central longitudinal axis, wherein said third radius is substantially equal to said first and said second radii and wherein a cross-sectional area of said generally triangular-shaped cylindrical body portion is smaller than a cross-sectional area of each of said circular-shaped cylindrical upper and lower body portions each cross-section taken perpendicular to said central longitudinal axis; and e. a closure.

15. The feeding bottle in claim 14, said bottle further comprising an anti-tamper ring, said ring being removably attached to a bottom rim of said closure by a plurality of frangible breakaway tongues.

16. The feeding bottle in claim 15, said ring further comprising radially inwardly extending ridges for engaging a bottom surface of said annular flange, wherein said ring removably secures said closure to said bottle.

17. The feeding bottle in claim 14, said closure further comprising:

a. an annular cap, said cap comprising, an annular end wall defning an aperture therein, and a second helical thread formed on an inner circumference of said annular cap, and b. a nipple that is press-fitable to the bottom surface of said annular end wall and extending through said aperture, wherein said second thread is adapted to receive said first thread for removably receiving said annular cap onto said cylindrical top portion.

18. The feeding bottle in claim 14, said bottle further comprising a removably attached safety seal attached over said mouth to said upper rim portion.

19. A feeding bottle comprising:

a. a cylindrical top portion adapted to removably receive a closure, said top portion having a circular upper rim portion defining a mouth;

b. a circular-shaped cylindrical upper body portion having a first radius, said circular-shaped cylindrical upper body portion integrally formed with said cylindrical threaded top portion;

c. a circular-shaped cylindrical lower body portion having a second radius;

d. a generally triangular-shaped cylindrical body portion intermediate said circular-shaped cylindrical upper and lower body portions, said generally triangular-shaped body portion including a first and a second generally planar wall and an arched third wall defined by a third radius perpendicular to said central longitudinal axis, wherein said third radius is substantially equal to said first and said second radii, and wherein a cross-sectional area of said generally triangular-shaped cylindrical body portion is smaller than a cross-sectional area of each of said circular-shaped cylindrical upper and lower body portions each cross-section taken perpendicular to said central longitudinal axis; and e. infant formula contained within the bottle.

20. The feeding bottle in claim 19, said bottle further comprising a removably attached safety seal placed over said mouth and attached to said circular upper rim portion.

* * * * *